US011858700B2

(12) United States Patent
Delmée et al.

(10) Patent No.: US 11,858,700 B2
(45) Date of Patent: Jan. 2, 2024

(54) SHIPPING/RESHIPPING PACKAGING UNIT AND PRECUT TEMPLATE FOR FORMING THE LATTER

(71) Applicant: DS SMITH PACKAGING FRANCE S.A.S., Puteaux (FR)

(72) Inventors: Emmanuel Delmée, Tillé (FR); Florian Rebergue, Brétigny-sur-Orge (FR)

(73) Assignee: DS SMITH PACKAGING FRANCE S.A.S., Puteaux (FR)

( * ) Notice: Subject to any disclaimer, the term of this patent is extended or adjusted under 35 U.S.C. 154(b) by 248 days.

(21) Appl. No.: 17/279,142

(22) PCT Filed: Sep. 25, 2019

(86) PCT No.: PCT/IB2019/058121
§ 371 (c)(1),
(2) Date: Mar. 24, 2021

(87) PCT Pub. No.: WO2020/065546
PCT Pub. Date: Apr. 2, 2020

(65) Prior Publication Data

US 2021/0394949 A1 Dec. 23, 2021

(30) Foreign Application Priority Data

Sep. 26, 2018 (FR) ..... 1871093

(51) Int. Cl.
*B65D 5/02* (2006.01)
*B65D 5/32* (2006.01)
*B65D 5/54* (2006.01)

(52) U.S. Cl.
CPC ..... *B65D 5/0227* (2013.01); *B65D 5/321* (2013.01); *B65D 5/541* (2013.01)

(58) Field of Classification Search
CPC ..... B65D 5/0227; B65D 5/321; B65D 5/541; B65D 2401/10; B65D 77/32; B65D 27/06; B65D 27/14
(Continued)

(56) References Cited

U.S. PATENT DOCUMENTS 3,141,598 A * 7/1964 Rasmussen ..... B65D 5/541 229/240
3,270,947 A * 9/1966 Rasmussen ..... B65D 5/541 229/222

(Continued)

FOREIGN PATENT DOCUMENTS

DE 20107792 U1 9/2002
EP 2196399 A1 6/2010

OTHER PUBLICATIONS

PCT International Search Report and Written Opinion for PCT Patent Application No. PCT/IB2019/058121 dated Dec. 6, 2019. English translation of ISR provided.

*Primary Examiner* — Christopher R Demeree
(74) *Attorney, Agent, or Firm* — McAndrews, Held & Malloy, Ltd.

(57) ABSTRACT

The invention relates to a shipping and reshipping packaging unit comprising a packaging body (C) and at least one closure panel (27, 77) and means for maintaining the closure panel (27, 77) in a closed position of the packaging body (C) by adhesion, characterized in that the maintaining means comprise at least one closure strip (B) comprising at least one separable portion (31, 33, 52) connected to the rest of the closure strip (B) and/or to the rest of the packaging unit, namely the body and/or the closure panel (27, 77), by at least one weaker line, and at least one permanent portion (32, 51, 53) that is substantially aligned with the separable portion (31, 33, 52) and remains integral with the rest of the packaging unit after separation of the separable portion (31, (Continued)

Figure 1:
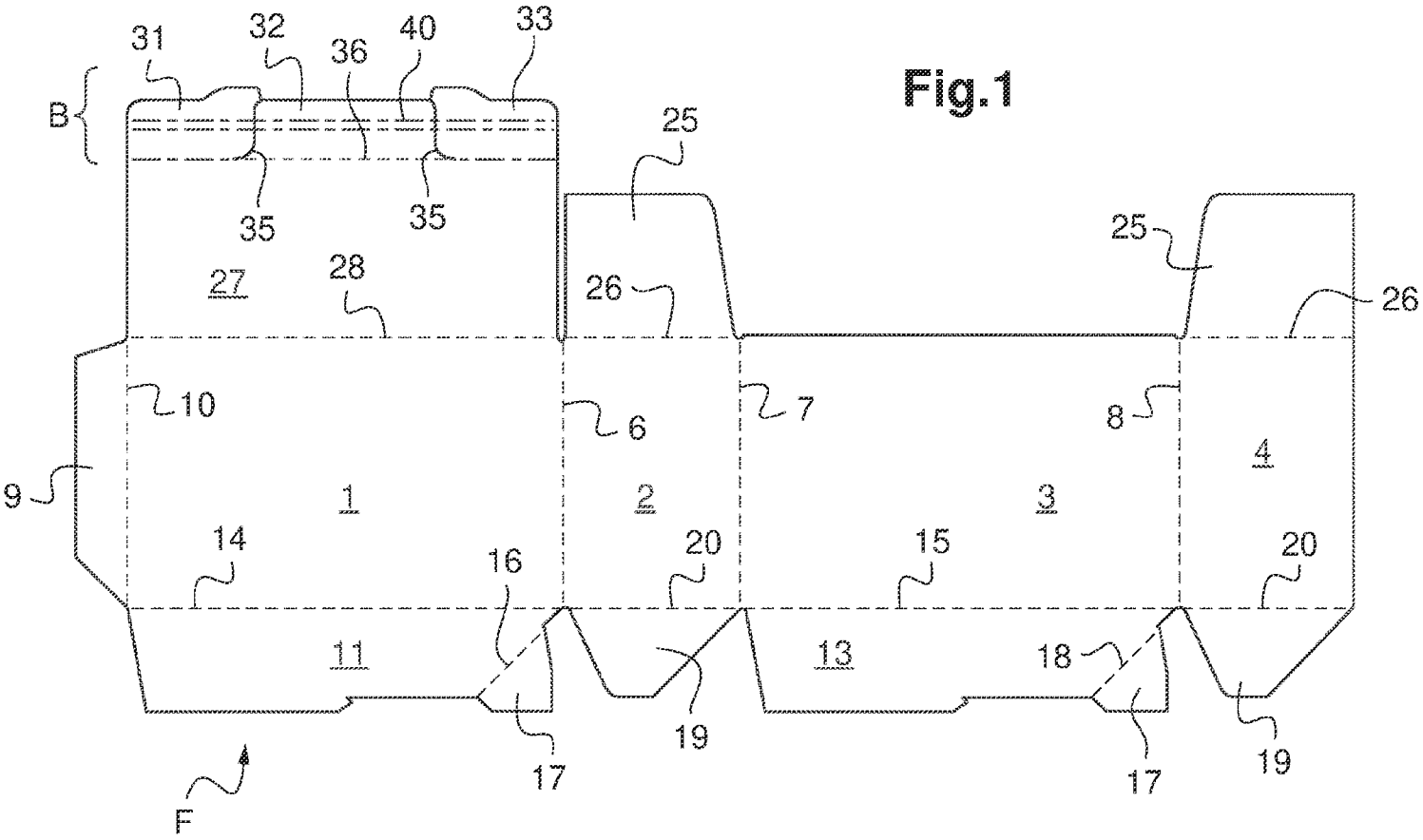

33, 52), the closure strip (B) bearing, on a face, referred to as internal face, intended to be oriented towards the interior of the packaging unit when the latter is closed, at least one rectilinear adhesive strip (40) extending at least partially along the length of the closure strip (B), including over the separable portion (31, 33, 52) and permanent portion (32, 51, 53) and being covered by a protector that is peelable into a plurality of individually peelable portions (41, 42, 42) corresponding at least to the separable and permanent portions of the closure strip (B).

9 Claims, 8 Drawing Sheets

(58) Field of Classification Search
USPC ..... 229/123.2, 240, 244, 102, 125.33, 127, 229/210, 212, 222, 241, 234, 247; 220/359.2; 53/412
See application file for complete search history.

(56) References Cited

U.S. PATENT DOCUMENTS

| | | | | |
|---|---|---|---|---|
| 6,435,404 | B1 | 8/2002 | Feick | |
| 2003/0201315 | A1* | 10/2003 | Jamison | B65D 5/0227 229/102 |
| 2008/0083822 | A1* | 4/2008 | Benes | B65D 5/4608 229/185.1 |
| 2014/0305944 | A1* | 10/2014 | Lahlouh | B65D 5/546 229/125.33 |
| 2016/0122069 | A1* | 5/2016 | Eisen | B65D 5/547 229/210 |
| 2016/0137335 | A1 | 5/2016 | Mora | |
| 2021/0284382 | A1* | 9/2021 | Walters | B65D 5/541 |

* cited by examiner

SHIPPING/RESHIPPING PACKAGING UNIT AND PRECUT TEMPLATE FOR FORMING THE LATTER

CROSS-REFERENCE TO RELATED APPLICATIONS

The present application is a National Phase Entry of PCT International Application No. PCT/IB2019/058121 which was filed on Sep. 25, 2019, which claims priority to French Application No. 1871093, filed Sep. 26, 2018, all of which are hereby incorporated by reference in their entireties.

The present invention relates to the technical field of shipping and reshipping packagings and pre-cut blanks for the formation of such shipping and reshipping packagings.

In the above-mentioned field, packagings are known which comprise a packaging body, a closure panel and means for holding the closure panel in the closed position of the packaging body. The holding means comprise, for example, a closure strip carrying an adhesive on its internal face and being associated with a tear strip arranged over the whole length of the closure strip between this latter and the rest of the packaging. Firstly, the closure strip makes it possible to hold the closure panel closed and to secure the packaging against malicious intrusions by its sticking on the packaging. Secondly, the opening of the packaging is facilitated by the tearing of the tear strip to separate one side of the closure strip from the rest of the packaging, hence allowing the closure panel to be opened.

Such a packaging thus offers possibilities of reliable and easy closure as well as quick opening. However, if the user wants to send back the content he has received by means of the same packaging, he will necessarily need external means such as a roll of adhesive tape to securely reseal the packaging before sending it back. But the user does not always have adhesive tape at his disposal.

In order to remedy this drawback, the invention relates to a shipping and reshipping packaging comprising a packaging body and at least one closure panel and means for adhesively holding the closure panel in the closed position of the packaging body. According to the invention, the holding means comprise at least one closure strip comprising at least one severable segment joined to the rest of the closure strip and/or to the rest of the packaging, i.e. the body and/or the closure panel, by at least one weakening line and at least one permanent segment substantially aligned with the severable segment and remaining integral with the rest of the packaging after separation of the severable segment, the closure strip carrying, on a so-called internal face intended to be directed towards the inside of the packaging when the latter is closed, at least one rectilinear strip of adhesive extending at least in part over the length of the joining strip, including over the severable and permanent segments, and being covered with a peelable protection made of several individually peelable segments corresponding at least to the severable and permanent segments of the closure strip.

The implementation of a closure strip, comprising severable and permanent segments, allows a first closure of the packaging by means of the severable segment(s) stuck in such a way as to immobilize the closure panel in the closed position. When the user receives the packaging according to the invention, closed, he breaks the weakening lines in such a way as to separate the severable segment(s) from the rest of the packaging, which makes it possible to open the closure panel. If the user wants to securely reseal the packaging according to the invention, he first removes the peelable segment of the protection covering the adhesive of the permanent segment of the closure strip then, he sticks the permanent segment so as to immobilize the closure panel in the closed position of the packaging. It hence appears that the packaging according to the invention advantageously offers the user the possibility to securely reseal the packaging, in a manner that is compatible with a reshipping, without having to use external means.

It must be noted that the alignment of the constituent segments of the closure strip facilitates the application of the adhesive in the form of a continuous or discontinuous tape over the length of the closure strip, in particular when the constituent elements of the packaging according to the invention are formed from a plate material in such as solid cardboard or corrugated cardboard. The adhesive may also be placed in a discontinuous manner in the form of independent segments that are not contiguous but aligned over the length of the closure strip.

According to a preferred embodiment of the invention, each closure strip comprises at least three aligned segments arranged in a permanent segment—severable segment alternation. This arrangement makes it possible to guarantee the holding efficiency of the closure panel whether by means of the severable segment(s) or by means of the permanent segment(s). When the closure strip comprises only three aligned segments, two configurations are then possible: the central segment is a permanent segment and the two lateral segments are severable segments or the central segment is a severable segment and the two lateral segments are permanent segments.

According to a feature of the invention, the closure strip comprises two lateral tabs extending, on either side, beyond the packaging element to which the closure strip is joined and each carrying a portion of the adhesive strip covered by a segment of the peelable protection. The presence of lateral tabs on the closure strip makes it possible to better secure the immobilization of the closure panel and, as the case may be, to also contribute towards the shaping and the solidity of the packaging body.

According to an alternative to this feature, the two tabs form at least in part two severable segments of the closure strip.

According to a feature of the invention, each permanent segment is joined by a folding line to the packaging element with which the closure strip is integral.

According to another feature of the invention, the closure panel is independent of the packaging body. It must hence be understood that, according to this feature, the packaging according to the invention is initially formed of at least two distinct sub-sets, i.e. a constituent sub-set of the packaging body and a sub-set comprising the closure panel. Of course, according to the invention, the packaging can be consisted of more than two sub-sets or on the contrary formed from a single unitary element such as a pre-cut blank shaped by folding and sticking.

According to an alternative to the preceding feature, the packaging body is integral with at least one closure strip comprising at least one severable segment and one permanent segment.

According to another alternative to this feature, the closure panel is integral with at least one closure strip comprising at least one severable segment and one permanent segment.

According to still another feature of the invention, the closure panel is, in the open position, integral with the packaging body. This feature corresponds, for example, to the fact that the packaging is formed from a single pre-cut blank or to the fact that the closure panel cannot be easily, i.e. without being damaged, separated from the packaging body.

The invention also relates to a pre-cut blank, for the formation of a body of a shipping and reshipping packaging according to the invention, which comprises a series of panels joined by folding lines, at least one panel of which carries at least one closure strip comprising at least one severable segment and one permanent segment.

The invention also relates to a pre-cut blank, for closing a shipping and reshipping packaging according to the invention, which comprises a closure panel that carries at least one closure strip comprising at least one severable segment and one permanent segment.

The invention further relates to a pre-cut blank, for the formation of a packaging according to the invention, which comprises a series of panels joined by folding lines, at least one closure panel and at least one panel of which carries at least one closure strip comprising at least one severable segment and one permanent segment.

Of course, the different features, alternatives and embodiments of the invention can be associated with each other according to various combinations, insofar as they are not incompatible with each other or exclusive from each other.

Moreover, various other features of the invention emerge from the appended description made with reference to the drawings that illustrate non-limitative embodiments of a shipping and reshipping packaging according to the invention.

Figure 2:
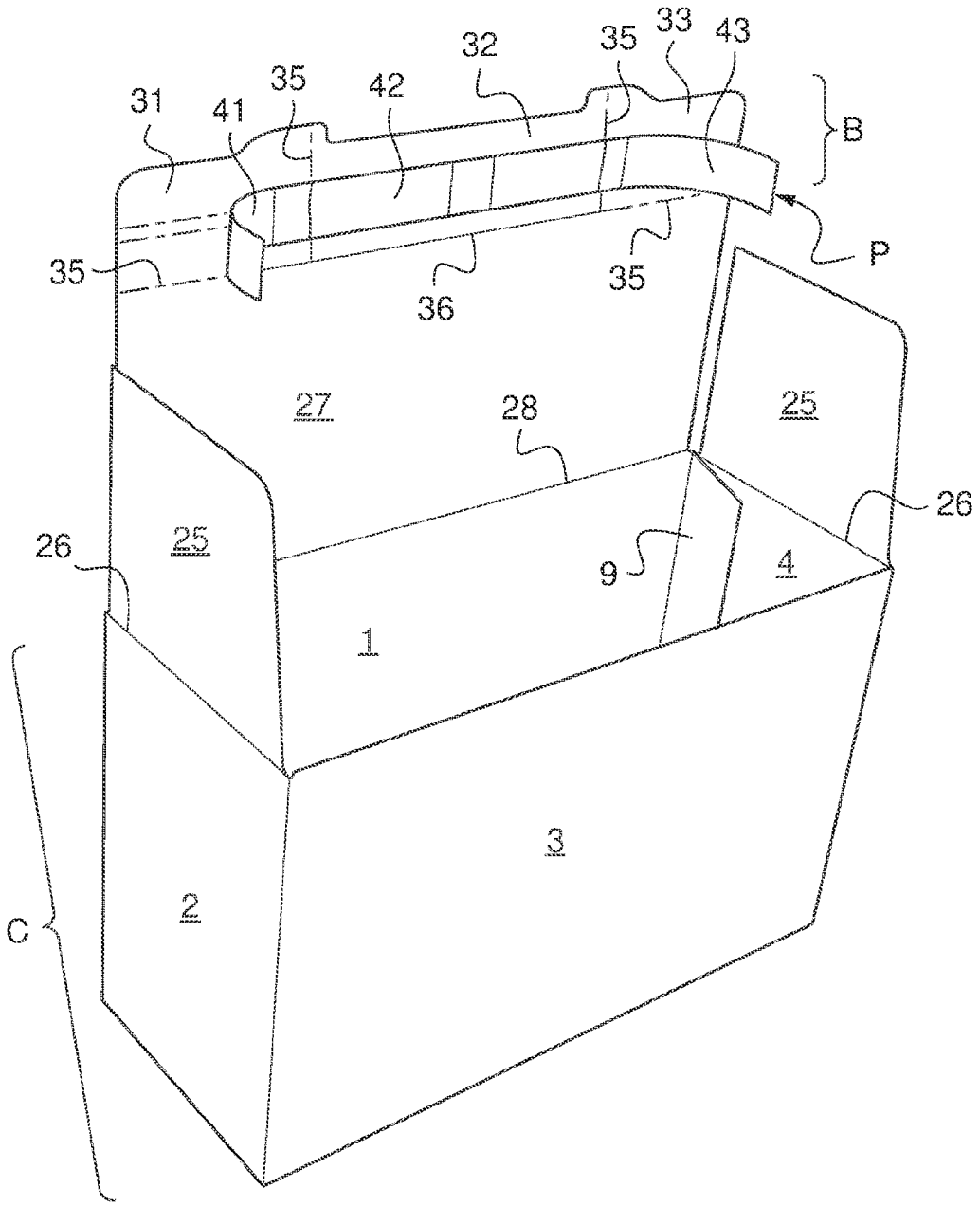
Figure 3:
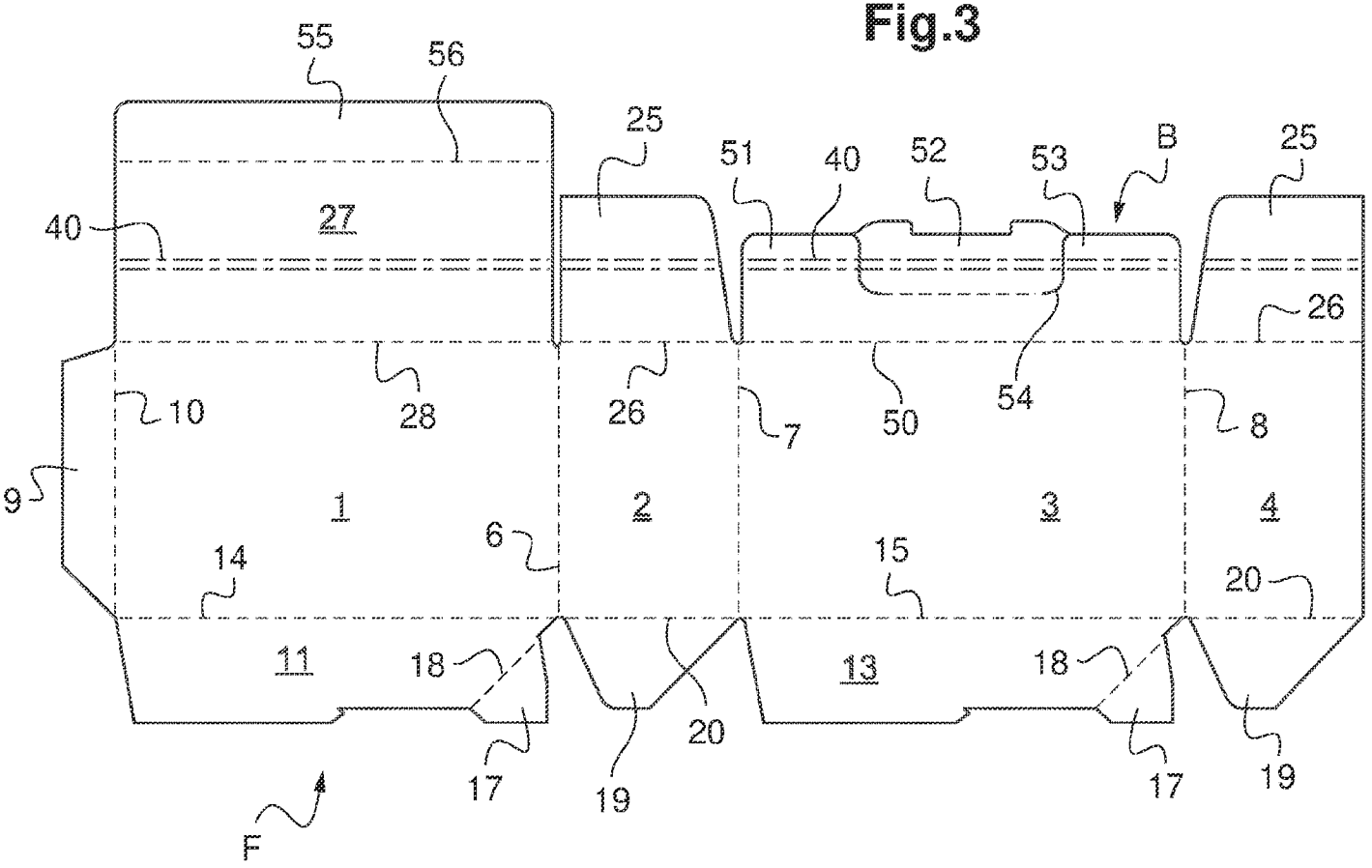
Figure 4:
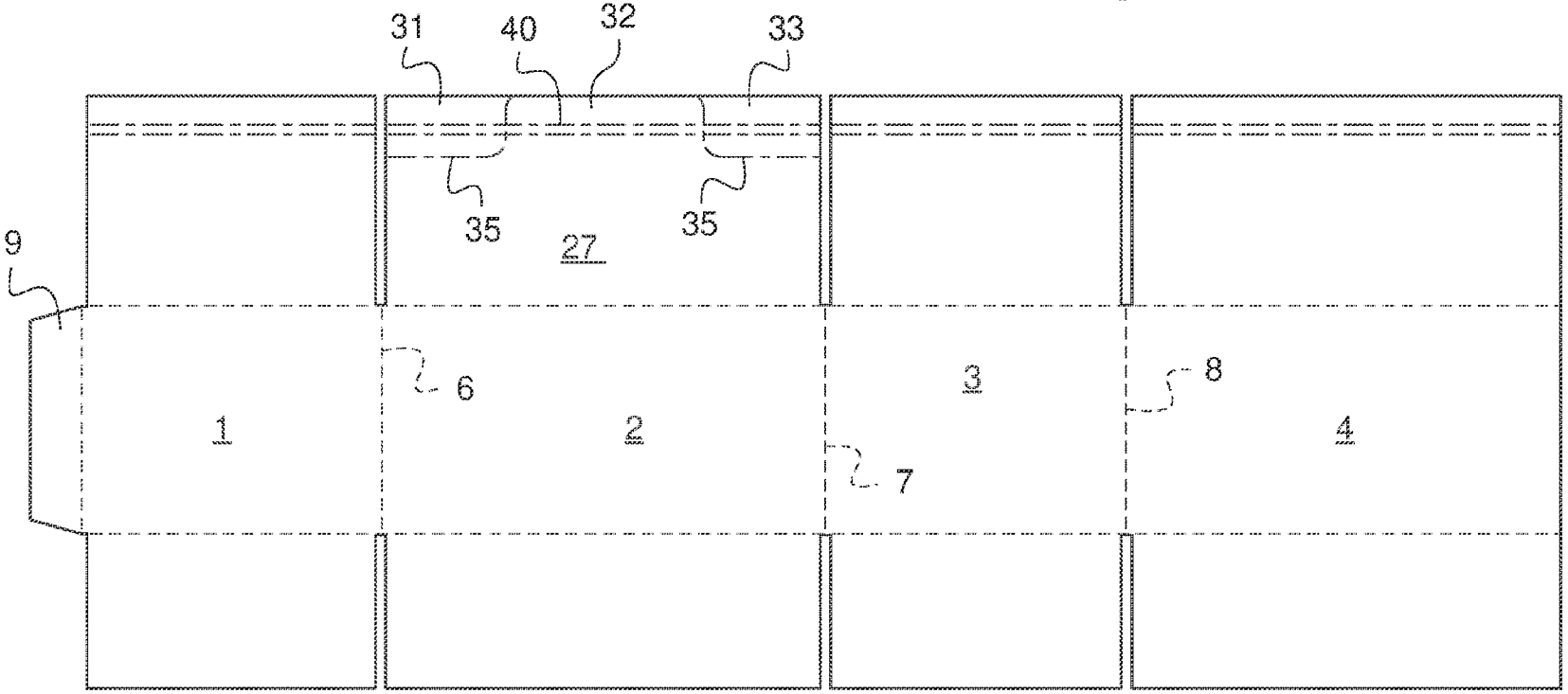
Figure 5:
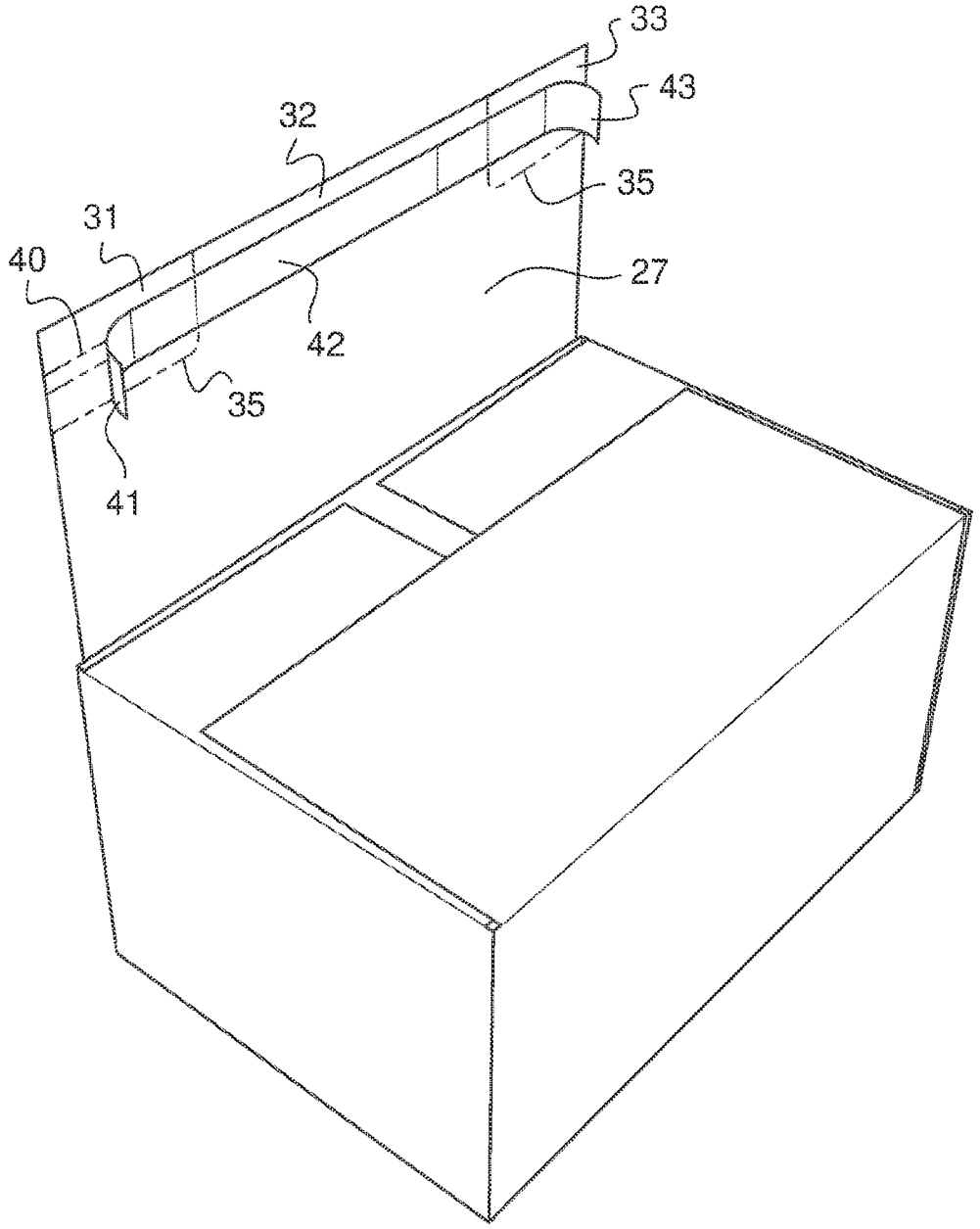
Figure 6:
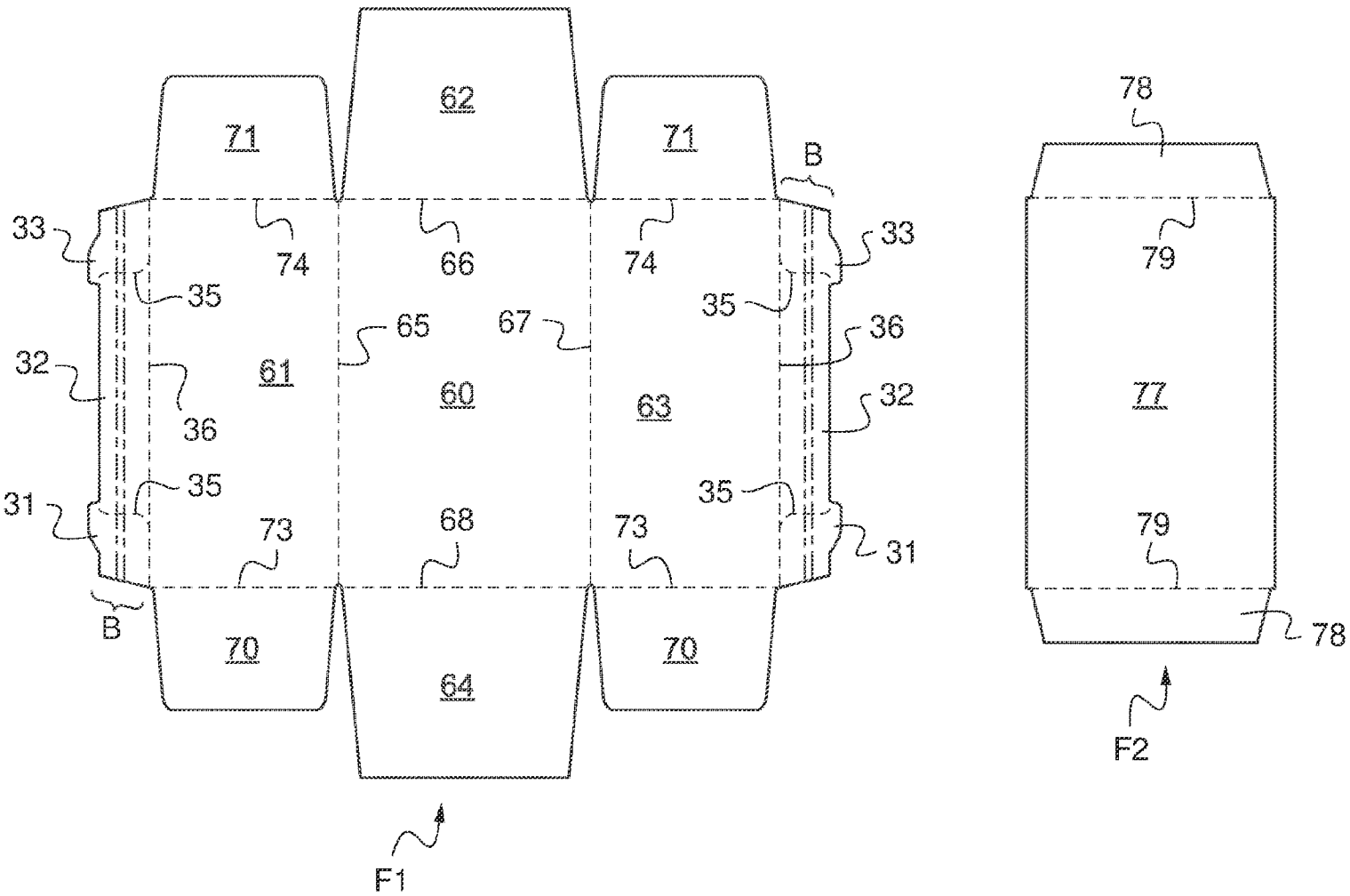
Figure 7:
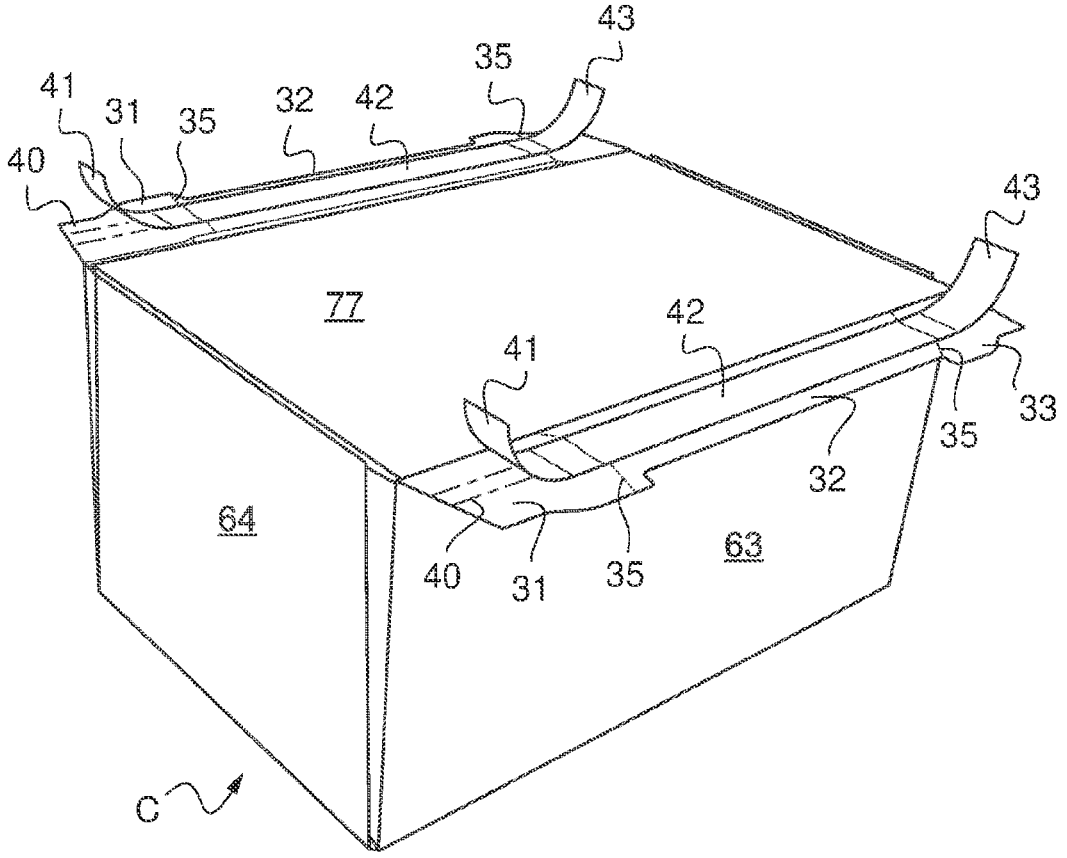
Figure 8:
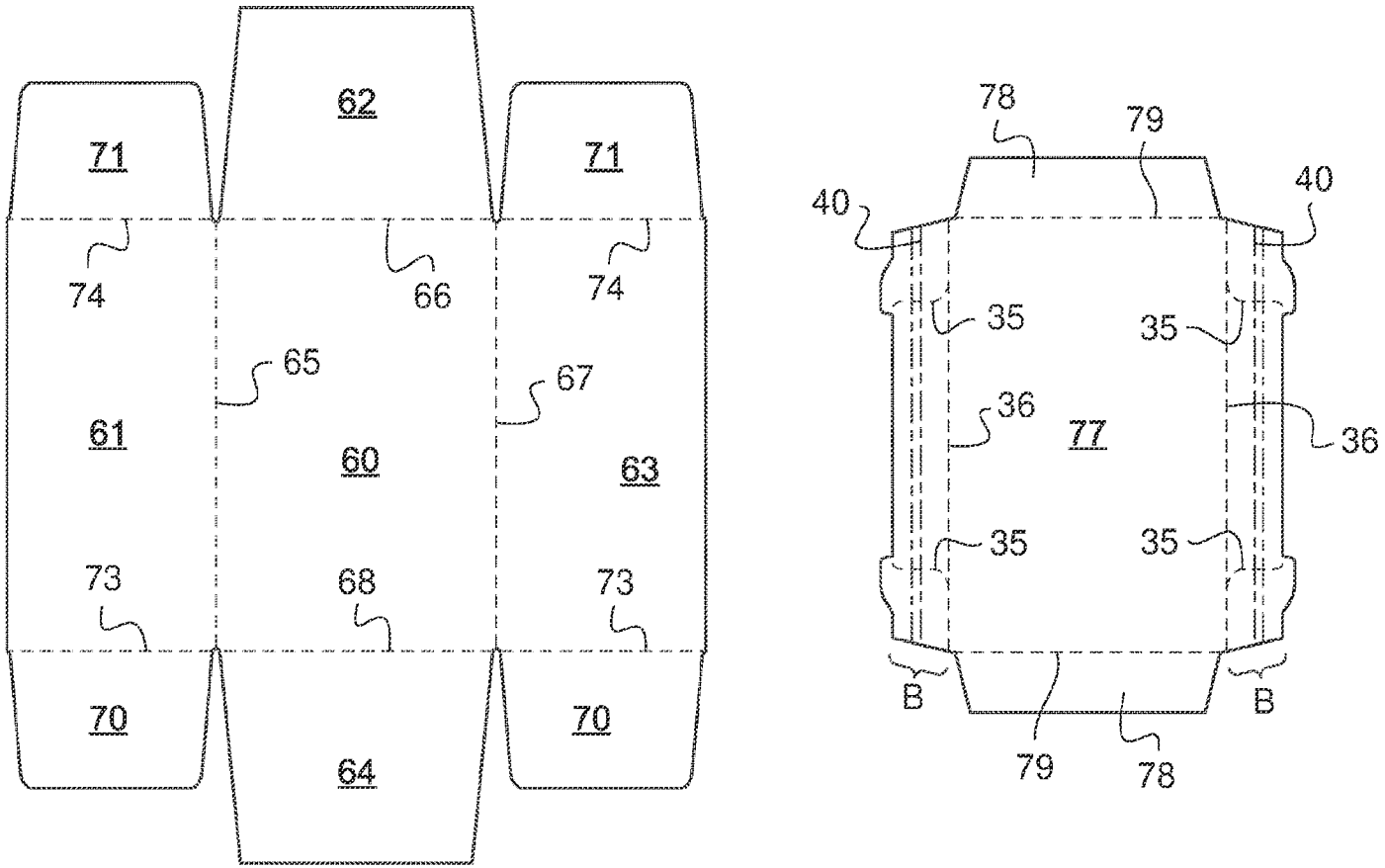

FIG. 1 is a flat view of a pre-cut blank for the formation of a packaging according to the invention, FIG. 2 is a schematic perspective view of the packaging formed from the blank illustrated in FIG. 1, FIG. 3 is a flat view of an alternative embodiment of the blank shown in FIG. 1, FIG. 4 is a flat view of a pre-cut blank for the making of another packaging embodiment according to the invention, FIG. 5 is a schematic perspective view of the packaging formed from the blank illustrated in FIG. 4, FIG. 6 is a flat view of pre-cut blanks for the making of still another packaging embodiment according to the invention, FIG. 7 is a schematic perspective view of the packaging formed from the blanks illustrated in FIG. 6, FIG. 8 is a flat view of alternative embodiments of the blanks shown in FIG. 6.

It is to be noted that, in these figures, the structural and/or functional elements common to the different alternatives can be denoted by the same references.

Moreover, in the flat views of pre-cut blanks for the formation of packagings according to the invention:

- the score lines and the contours of the pre-cut blank are shown in solid lines,
- the folding lines are shown in dotted lines,
- the weakening lines are shown in mixed lines,
- the adhesive lines are shown by a double mixed line.

The invention aims to propose a packaging allowing a facilitated and secured reshipping. The particularity of the packaging according to the invention lies in the implementation of a closure strip comprising at least one severable segment joined to the rest of the closure strip and/or to the rest of the packaging by at least one weakening line and at least one permanent segment substantially aligned with the severable segment and remaining integral with the rest of the packaging after separation of the severable segment. According to the invention, such a closure strip can be implemented on different types or shapes of packaging and preferentially the packagings made by the shaping of one or several pre-cut blanks of material, such as solid cardboard or corrugated cardboard or any other suitable material, not necessarily based on paper or cellulose.

According to a first embodiment more particularly illustrated in FIGS. 1 and 2, the closure strip 1 is implemented on an automatic-bottom packaging, of substantially parallelepipedal shape, formed from a single pre-cut blank more particularly illustrated in FIG. 1 and denoted as a whole by the reference F.

The blank F comprises an alignment of rectangular lateral panels 1, 2, 3, 4 separated from each other by substantially parallel folding lines 6, 7, 8. A first lateral panel 1 carries, at the opposite of the second lateral panel 2, a joining strip 9 from which it is separated by a folding line 10 parallel to the folding line 6.

According to the invention, the folding lines can be made in any suitable way, adapted to the nature of the constituent material of the blank, such as, for example, by grooving, mid-cut, dotted cut or combinations of these techniques without this list is exhaustive or limitative.

The first 1 and third 3 lateral panels each carry, on a same side of the alignment, a bottom half-panel, respectively 11 and 13, separated from the corresponding lateral panel by a folding line, respectively 14 and 15, substantially perpendicular to the folding lines 6, 7, 8. Each bottom half-panel 11, 13 carries a flap 17 articulated by a folding line 18, intended to be stuck on a bottom flap 19 carried by each of the second 2 and fourth 4 lateral panels.

Each bottom flap 19 is located on the same side of the alignment of the lateral panels 1 to 4 as the bottom half-panels 11 and 13. Each bottom flap 19 is further separated from the corresponding lateral panel 2, 4 by a folding line 20, on the one hand, perpendicular to the folding lines 6, 7, 8 and, on the other hand, substantially aligned with the folding lines 14 and 15.

The second 2 and fourth 4 lateral panels each carry, at the opposite of the bottom flap 19, a closure flap 25 separated from the corresponding lateral panel by a folding line 26 parallel to the folding line 20.

Finally, the first lateral panel 1 carries, at the opposite of the bottom half-panel 11, a closure panel 27 separated from the first lateral panel 1 by a folding line 28 parallel to the folding line 14 and perpendicular to the folding lines 10 and 6.

In the present case, the closure strip B is carried by the closure panel 27 at the opposite of the first lateral panel 1. According to this exemplary embodiment, the closure strip B comprises three aligned segments 31, 32 and 33. The first 31 and third 33 segments are said severable in that they are intended to be easily separable from the rest of the packaging, as can be seen in the following. In contrast, the second segment 32, located between the first 31 and third 33 segments, is said permanent in that it is intended to remain joined to the rest of the packaging within the framework of a normal use of the latter.

In order to allow an easy detachment of the severable segments 31 and 33 from the rest of the packaging, these latter are separated from the closure panel 27 and the permanent segment 32 by a weakening line 35 that has here substantially a "L" shape. The permanent segment 32 is for its part separated from the closure panel by a folding line 236 substantially parallel to the folding line 28.

It can be noticed that, in the present case, the portion of the weakening lines 35 located between the severable segments 31 and 33 and the closure panel 27 are substantially aligned with the folding line 36. However, such an embodiment is not strictly necessary, so the weakening lines can be offset towards the inside of the closure strip B and the folding line 36 extended over the whole length of the closure strip B between the latter and the closure panel 27.

The closure strip B further carries on its internal face, intended to be directed towards the inside of the packaging after the shaping and closure of the latter, a strip of adhesive 40 that extends parallel to the folding line 36 over all three segments 31 to 33.

The strip of adhesive 40 is covered with a peelable protection strip P visible in FIG. 2. The strip P is divided into at least three individually peelable segments 41, 42, 43 each corresponding to one of the three constituent segments 31, 32, 33 of the closure strip B.

The so-formed blank F is put in volume as follows, to form the packaging as illustrated in FIG. 2.

The folding lines 10, 6, 7, 8 are formed in such a way as to allow a sticking of the joining strip 9 on the internal face of the fourth lateral panel 4. Then, the folding lines 14, 15, 20 are formed in such a way as to fold the bottom half-panels 11, 13 and the bottom flaps 19 towards the inside of the packaging, each flap 17 being stuck on the corresponding bottom flap 19.

The packaging according to the invention is then in volume in the configuration as illustrated in FIG. 2. In this open state of the packaging, the closure panel 7 is integral with the body C of the packaging of substantially parallel-epipedal shape.

The packaging is hence ready to receive its content. Once the packaging filled, it is possible to close it by folding the flaps 25 towards the inside of the packaging to place them in a position substantially parallel to the bottom of the packaging.

It can then be proceeded to a first closure of the packaging. First, the peelable segments 41 and 43 covering the strip of adhesive at the severable segments 31 and 33 are removed. Then, the closure panel 27 is folded to be applied against the closure flaps 25. Finally, the closure strip B is folded in such a way as to be stuck by the severable segments 31 and 33 against the external face of the third lateral panel 3.

The packaging is then perfectly closed and secured, so that it is not possible to access its content without affecting the packaging integrity.

To easily open the packaging, a user must break the weakening lines 35 in such a way as to allow a separation of the severable segments 31 and 33 of the permanent segment 32 and of the closure panel 27. Once this break performed, it is possible to access the inside of the packaging. It will be noticed that the breaking of the weakening lines 35 constitutes an indicator of opening of the packaging, which makes it possible to indicate to the user whether he is the first person or not to open the packaging.

Insofar as the user would desire to reuse the packaging to, for example, return its content to the sender, he just has to fill the packaging then, in order to close it, to remove the peelable segment 42 covering the strip of adhesive of the permanent segment 32, and to stick the permanent segment 32 against the external face of the lateral panel 3.

The packaging according to the invention is hence again perfectly closed without the user needs to use external sticking means or an external adhesive tape to ensure a secured closure of said packaging.

In the embodiment described hereinabove in relation with FIGS. 1 and 2, the closure strip B is joined to the closure panel 27. However, such an embodiment is not strictly necessary. Hence, FIG. 3 illustrates a blank for the making of an automatic-bottom packaging very close to that described above, but that is different from the latter in particular in that the closure strip B is joined to the third lateral panel 3 at the opposite of the bottom half panel 13. The closure strip B is then separated from the lateral panel 3 by a folding line 50 parallel to the folding line 15 and perpendicular to the lines 6, 7, 8.

The closure strip B comprises three successive segments 51, 52, 53, the first 51 and the last 53 of which are permanent segments, whereas the second segment 52 is severable. For that purpose, the severable section 52 is delimited by a substantially "U"-shaped weakening line 54, which is remote from the folding line 50. As an alternative, the "U" core can coincide with the folding line 50. By "core", it is meant the joining portion of the two legs of the "U".

In accordance with a feature of the invention, the internal face of the closing strip B carries a line of adhesive 40 that extends over the three segments 51, 52, 53 and that is covered by a peelable protection divided into at least three segments, as described hereinabove. It will be noted that, according to the example illustrated, the strip of adhesive also extends over the closure panel 27 and the closure flaps 25 by being covered with a peelable protection at the panel 27 and the flaps 25. This situation is due the fact that the strip of adhesive 40 and its protection strip are continuously applied on the panel of constituent material of the blank F during the manufacturing of said panel and previously to the cutting, providing it with the shape of the blank illustrated in FIG. 3.

According to the example illustrated in FIG. 3, the closure panel 27 carries, at the opposite of the lateral panel 1, a closure flap 55 separated from the closure panel 27 by a folding line 56 parallel to the folding line 28.

The blank as illustrated in FIG. 3 is shaped in a manner substantially similar to that previously described in relation with FIGS. 1 and 2, so that it is not necessary to repeat it here.

The invention has just been described in relation with an automatic-bottom packaging. However, the invention can be applied to other types of packaging, as for example an American box, as illustrated in FIGS. 4 and 5. The putting in volume as illustrated in FIG. 5 of such an American box from the blank illustrated in FIG. 4 is well known from the person skilled in art, so that it is not necessary to further describe the constituent elements of the blank F of FIG. 4, nor its putting in volume.

It will however be noticed that, according to this exemplary embodiment, the closure strip B is integrated to the closure panel 27 without being separated from the later by a folding line. The closure strip B here comprises three segments 31, 32, 33 in a configuration very close to that described in relation with FIG. 1. The first 31 and third 33 segments are severable, whereas the central segment or second segment 32 is permanent.

According to the examples described above in relation with FIGS. 1 to 5, the packaging body and the closure panel are made from a same and single pre-cut blank. However, such an embodiment is not necessary for the making of a packaging according to the invention. Hence, FIGS. 6 and 7 show another embodiment according to which the packaging according to the invention is made from two pre-cut blanks more particularly illustrated in FIG. 6.

In the present case, the first blank F1 is intended to form the body C of the packaging, whereas the second blank F2 is intended to form a closure mean or lid for the packaging.

The first blank F1 comprises a rectangular bottom panel 60 lined on four sides by four lateral panels 61, 62, 63, 64 that are separated from the bottom panel by folding lines 65, 66, 76, 68 that form the sides of the bottom panel 60. Two opposite lateral panels 61 and 63 each carry two opposite lateral flaps 70, 71 separated from the corresponding lateral panel by two folding lines 73, 74 parallel to each other and to the folding lines 66 and 68.

The lateral panels 61 and 63 each further carry, at the opposite of the bottom panel, a closure strip B, whose making is very close to that described in relation with FIGS. 1 and 2. Thus, each of the two closure strips B comprises three aligned segments 31, 32, 33, the first 31 and third 33 segments of which are severable, whereas the second segment 32 is permanent. The severable segments 31, 33 are separated from the permanent segment 32 and from the corresponding lateral panel 61, 63 by a weakening line 35, whereas each permanent segment 32 is separated from the corresponding lateral panel by a folding line 36 parallel to the folding lines 65 and 67.

Each closure strip B further comprises a line of adhesive 40 extending over the three segments 30, 32, 33 at the internal face of the closure strip B. The line of adhesive 40 is covered by a protection strip divided into three segments 41, 42, 43 each corresponding to a segment of the closure strip B.

As indicated hereinabove, the pre-cut blank F2 is intended to form a lid for the packaging body made from the blank F1. For that purpose, the blank F2 comprises a closure panel 77 of rectangular shape and of size substantially similar to that of the bottom panel 60. The closure panel 77 is further lined on two opposite sides by a closing flap 78. Each closing flap is then separated from the closing panel 77 by a folding line 79, which defines a side of the closure panel 77.

The packaging body C is made by the shaping of the pre-cut blank F1 as follows. The folding lines 65 and 67 are formed so as to place the lateral panels 61 and 63 in vertical position, then the folding lines 73 and 74 are formed in such a way as to bring the lateral flaps 70 and 71 towards the inside of the packaging. Finally, the folding lines 66 and 68 are formed so as to stick the lateral panels 62 and 64 against the external face of the lateral flaps 70 and 71. The packaging body C is then in volume as illustrated in FIG. 7.

Once the filling of the packaging body made, the latter is closed by means of the closure panel 77 placed on the packaging body with the closure flaps 78 inside the latter. The locking of the packaging is then ensured by sticking the severable segments 31 and 32 of the two closure strips B on the upper face of the closure panel 77.

The opening of the so-closed packaging will be made by breaking of the weakening lines 35 as already described hereinabove. The second closure of the packaging will be ensured by means of the permanent segments 32 stuck, after removal of the protection segments 42, on the upper face of the closure panel 77.

FIG. 8 illustrates an alternative embodiment of the pre-cut blanks F1 and F2 that differs from the embodiment described hereinabove in that the closure strips are carried by the closure panel 77 instead of being integrated to the blank F1 intended to form the packaging body.

Of course, various other modifications can be made to a packaging according to the invention within the framework of the appended claims.

What is claimed is:

1. A shipping and reshipping packaging comprising a packaging body and at least one closure panel and means for adhesively holding the closure panel in the closed position of the packaging body, characterized in that the holding means comprise at least one closure strip comprising at least one severable segment, joined to the rest of the closure strip and/or to the rest of the packaging, i.e. the body and/or the closure panel, by at least one weakening line and at least one permanent segment substantially aligned with the severable segment and remaining integral with the rest of the packaging after separation of the severable segment, the closure strip carrying, on an internal face intended to be oriented towards the inside of the packaging during the closure of the latter, a rectilinear strip of adhesive extending at least in part over the length of the closure strip, said rectilinear strip of adhesive extending over the at least one severable segment and over the at least one permanent segment, and being covered with a peelable protection made of several individually peelable segments corresponding at least to the severable and permanent segments of the closure strip.

2. The packaging according to the preceding claim, characterized in that each closure strip comprises at least three segments.

3. The packaging according to claim 1, characterized in that each permanent segment is joined by a folding line to the packaging element with which the closure strip is integral.

4. The packaging according to claim 1, characterized in that the closure panel is independent of the packaging body.

5. The packaging according to the preceding claim, characterized in that the packaging body is integral with at least one closure strip comprising at least one severable segment and one permanent segment.

6. The packaging according to claim 4, characterized in that the closure panel is integral with at least one closure strip comprising at least one severable segment and one permanent segment.

7. The packaging according to claim 1, characterized in that the closure panel is, in the open position, integral with the packaging body.

8. The packaging according to claim 1, characterized in that it is formed by folding, and optionally gluing, at least one pre-cut blank.

9. A pre-cut blank for the formation of a packaging according to claim 8, characterized in that it comprises a series of panels joined by folding lines, at least one closure panel and at least one panel of which carry at least one closure strip comprising at least one severable segment and one permanent segment.

* * * * *